US010764971B2

(12) United States Patent
Carcano et al.

(10) Patent No.: US 10,764,971 B2
(45) Date of Patent: Sep. 1, 2020

(54) WAVEGUIDE ASSEMBLY FOR AN RF OVEN

(71) Applicant: ILLINOIS TOOL WORKS INC., Glenview, IL (US)

(72) Inventors: Marco Carcano, Senago (IT); Michele Sclocchi, San Donato Milanese (IT); Michele Gentile, Jesi (IT)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 330 days.

(21) Appl. No.: 15/803,891

(22) Filed: Nov. 6, 2017

(65) Prior Publication Data

US 2018/0153001 A1 May 31, 2018

Related U.S. Application Data

(60) Provisional application No. 62/428,084, filed on Nov. 30, 2016.

(51) Int. Cl.

| | |
|---|---|
| ***H05B 6/70*** | (2006.01) |
| ***H05B 6/72*** | (2006.01) |
| ***H05B 6/68*** | (2006.01) |

(52) U.S. Cl.

CPC ..... *H05B 6/707* (2013.01); *H05B 6/686* (2013.01); *H05B 6/687* (2013.01); *H05B 6/72* (2013.01)

(58) Field of Classification Search

CPC ..... H05B 6/707; H05B 6/687; H05B 6/686
USPC ..... 219/696, 702, 748, 756, 761
See application file for complete search history.

(56) References Cited

U.S. PATENT DOCUMENTS

| | | | | |
|---|---|---|---|---|
| 8,658,953 | B2 | 2/2014 | McFadden et al. | |
| 8,803,051 | B2 | 8/2014 | Lee et al. | |
| 2009/0095740 | A1* | 4/2009 | Buchala ..... | B65D 81/3446 219/725 |

(Continued)

FOREIGN PATENT DOCUMENTS

| | | | |
|---|---|---|---|
| CN | 202733977 | U * | 2/2013 |
| CN | 105485732 | A * | 4/2016 |

(Continued)

OTHER PUBLICATIONS

International Search Report and Written Opinion of PCT/US2017/060330 dated Feb. 23, 2018, all enclosed pages cited.

*Primary Examiner* — Thien S Tran
(74) *Attorney, Agent, or Firm* — Burr & Forman, LLP

(57) ABSTRACT

An oven includes a cooking chamber configured to receive a food product and an RF heating system configured to provide RF energy into the cooking chamber using solid state electronic components. The cooking chamber is defined at least in part by a top wall, a first sidewall and a second sidewall. The solid state electronic components include power amplifier electronics configured to provide the RF energy into the cooking chamber via a launcher assembly operably coupled to the cooking chamber via a waveguide assembly. The waveguide assembly includes a waveguide extending along at least one of the first sidewall or the second sidewall to provide the RF energy into the cooking chamber through a radiation opening provided at the at least one of the first sidewall or the second sidewall. The launcher assembly includes a launcher disposed proximate to a first end of the waveguide and the radiation opening is disposed proximate to a second end of the waveguide.

16 Claims, 11 Drawing Sheets

(56) References Cited

U.S. PATENT DOCUMENTS

| | | | | |
|---|---|---|---|---|
| 2010/0176123 | A1* | 7/2010 | Mihara | H05B 6/686<br>219/746 |
| 2016/0183332 | A1 | 6/2016 | Frank et al. | |

FOREIGN PATENT DOCUMENTS

| | | | | |
|---|---|---|---|---|
| CN | 105485732 | A | | 4/2016 |
| EP | 1725076 | A1 | | 11/2006 |
| JP | 2011176726 | A | * | 9/2011 |

* cited by examiner

WAVEGUIDE ASSEMBLY FOR AN RF OVEN

CROSS REFERENCE TO RELATED APPLICATIONS

This application claims priority to U.S. application No. 62/428,084 filed Nov. 30, 2016, the entire contents of which are incorporated by reference in their entirety.

TECHNICAL FIELD

Example embodiments generally relate to ovens and, more particularly, relate to an oven that uses radio frequency (RF) heating provided by solid state electronic components and the waveguide assembly that delivers RF energy for the oven.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, even by employing a combination of microwave and airflow, the limitations of conventional microwave cooking relative to penetration of the food product may still render the combination less than ideal. Moreover, a typical microwave is somewhat indiscriminate or uncontrollable in the way it applies energy to the food product. Thus, it may be desirable to provide further improvements to the ability of an operator to achieve a superior cooking result. However, providing an oven with improved capabilities relative to cooking food with a combination of controllable RF energy and convection energy may require the structures and operations of the oven to be substantially redesigned or reconsidered.

BRIEF SUMMARY OF SOME EXAMPLES

Some example embodiments may therefore provide improved structures and/or systems for applying heat to the food product in the oven. For example, some embodiments may provide an improved waveguide structure for delivery of RF energy into the cooking chamber of the oven.

In an example embodiment, an oven is provided. The oven may include a cooking chamber configured to receive a food product and an RF heating system configured to provide RF energy into the cooking chamber using solid state electronic components. The cooking chamber is defined at least in part by a top wall, a first sidewall and a second sidewall. The solid state electronic components include power amplifier electronics configured to provide the RF energy into the cooking chamber via a launcher assembly operably coupled to the cooking chamber via a waveguide assembly. The waveguide assembly includes a waveguide extending along at least one of the first sidewall or the second sidewall to provide the RF energy into the cooking chamber through a radiation opening provided at the at least one of the first sidewall or the second sidewall. The launcher assembly includes a launcher disposed proximate to a first end of the waveguide and the radiation opening is disposed proximate to a second end of the waveguide.

In an example embodiment, a waveguide assembly for delivering RF energy generated by solid state electronic components into an oven is provided. The oven may include a cooking chamber configured to receive a food product. The cooking chamber may be defined at least in part by a top wall, a first sidewall and a second sidewall. The waveguide assembly may include a waveguide extending along at least one of the first sidewall or the second sidewall, and a radiation opening provided at the at least one of the first sidewall or the second sidewall to provide the RF energy into the cooking chamber from the waveguide. A launcher may also be disposed proximate to a first end of the waveguide and the radiation opening is disposed proximate to a second end of the waveguide.

Some example embodiments may improve the cooking performance or operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
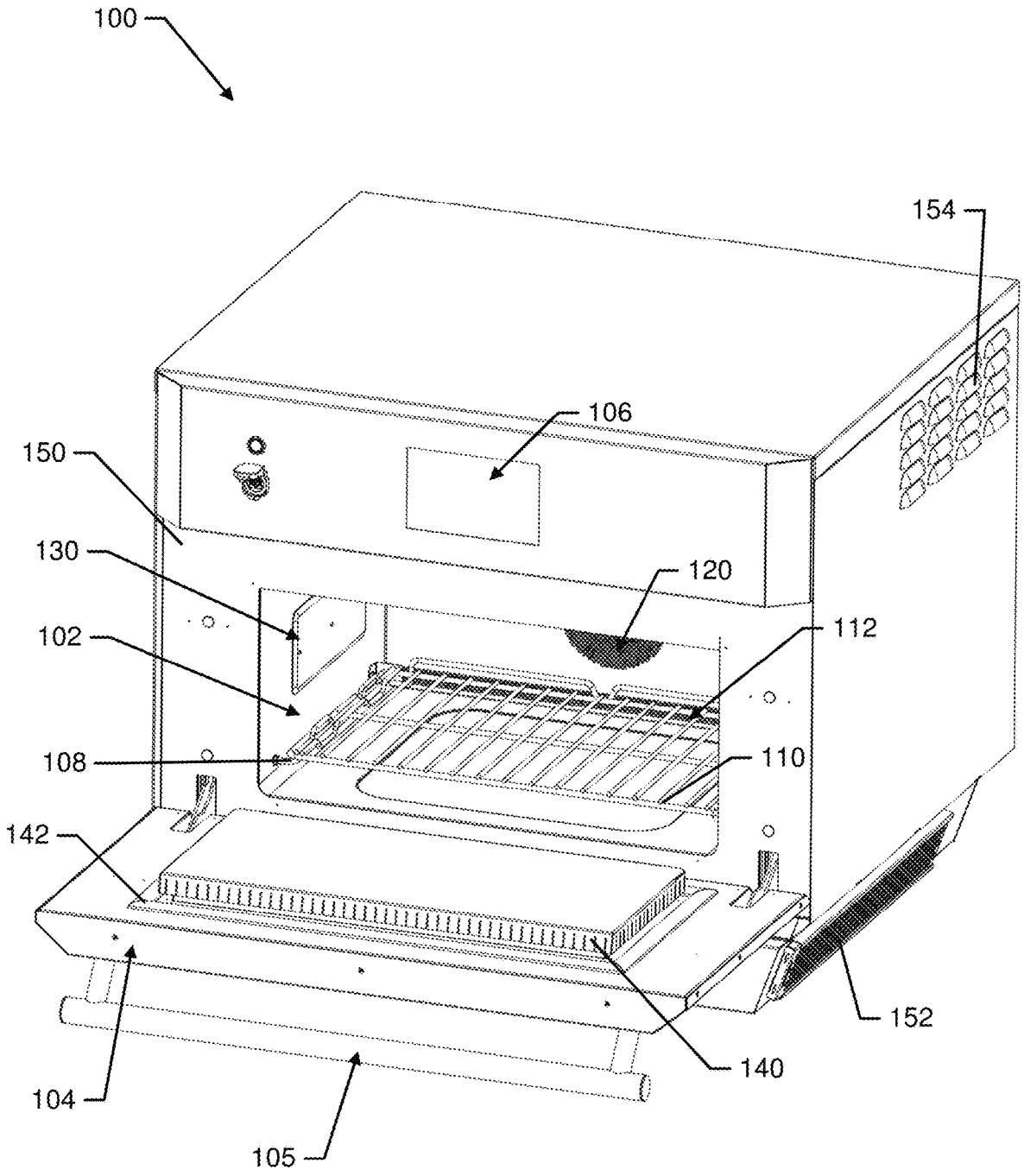
FIG. 1 illustrates a perspective view of an oven capable of employing an RF energy source according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food relatively quickly and uniformly, based on the application of RF energy under the instruction of control electronics that are configured to control solid state RF generation equipment for delivering into the cooking chamber of the oven via a waveguide assembly.

FIG. 1 illustrates a perspective view of an oven 1 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 parallel to the ground. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a back or rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through the system by other components prior to return of the clean, hot and speed controlled air back into the cooking chamber 102. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. Furthermore, the inlet array 152 is at least partially shielded from any direct communication path from the outlet louvers 154 by virtue of the fact that, at the oven sides (which include both portions of the inlet array 152 and outlet louvers 154), the shape of the basement is such that the tapering of the inlet array 152 is provided on walls that are also slightly inset to create an overhang 158 that blocks any air path between inlet and outlet. As such, air drawn into the inlet array 152 can reliably be expected to be air at ambient room temperature, and not recycled, expelled cooling air.

Figure 2:
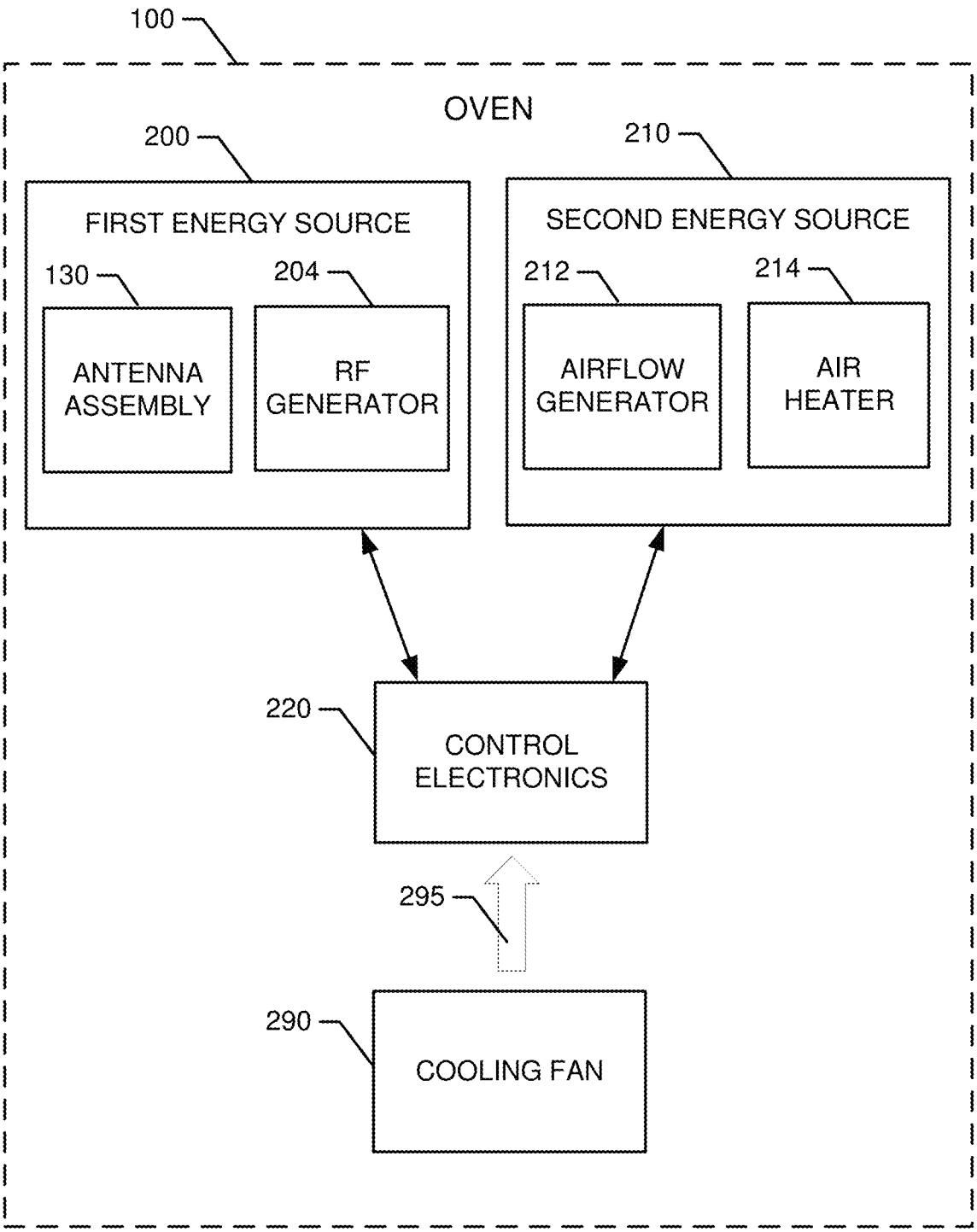
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102. The RF transparent coverings (or cover plates) may be made of, for example, high-purity quartz, alumina, ceramic windows, and/or other flexible or rigid covering materials that are substantially transparent to RF energy.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

As discussed above, the first air circulation system may be configured to drive heated air through the cooking chamber 102 to maintain a steady cooking temperature within the cooking chamber 102. Meanwhile, the second air circulation system may cool the control electronics 220. The first and second air circulation systems may be isolated from each other. However, each respective system generally uses differential pressures (e.g., created by fans) within various compartments formed in the respective systems to drive the corresponding air flows needed for each system. While the airflow of the first air circulation system is aimed at heating food in the cooking chamber 102, the airflow of the second air circulation system is aimed at cooling the control electronics 220. As such, cooling fan 290 provides cooling air 295 to the control electronics 220, as shown in FIG. 2.

The structures that form the air cooling pathways via which the cooling fan 290 cools the control electronics 220 may be designed to provide efficient delivery of the cooling air 295 to the control electronics 220, but also minimize fouling issues or dust/debris buildup in sensitive areas of the oven 100, or areas that are difficult to access and/or clean. Meanwhile, the structures that form the air cooling pathways may also be designed to maximize the ability to access and clean the areas that are more susceptible to dust/debris buildup. Furthermore, the structures that form the air cooling pathways via which the cooling fan 290 cools the control electronics 220 may be designed to strategically employ various natural phenomena to further facilitate efficient and effective operation of the second air circulation system. In this regard, for example, the tendency of hot air to rise, and the management of high pressure and low pressure zones necessarily created by the operation of fans within the system may each be employed strategically by the design and placement of various structures to keep certain areas that are hard to access relatively clean and other areas that are otherwise relatively easy to access more likely to be places where cleaning is needed.

Figure 3:
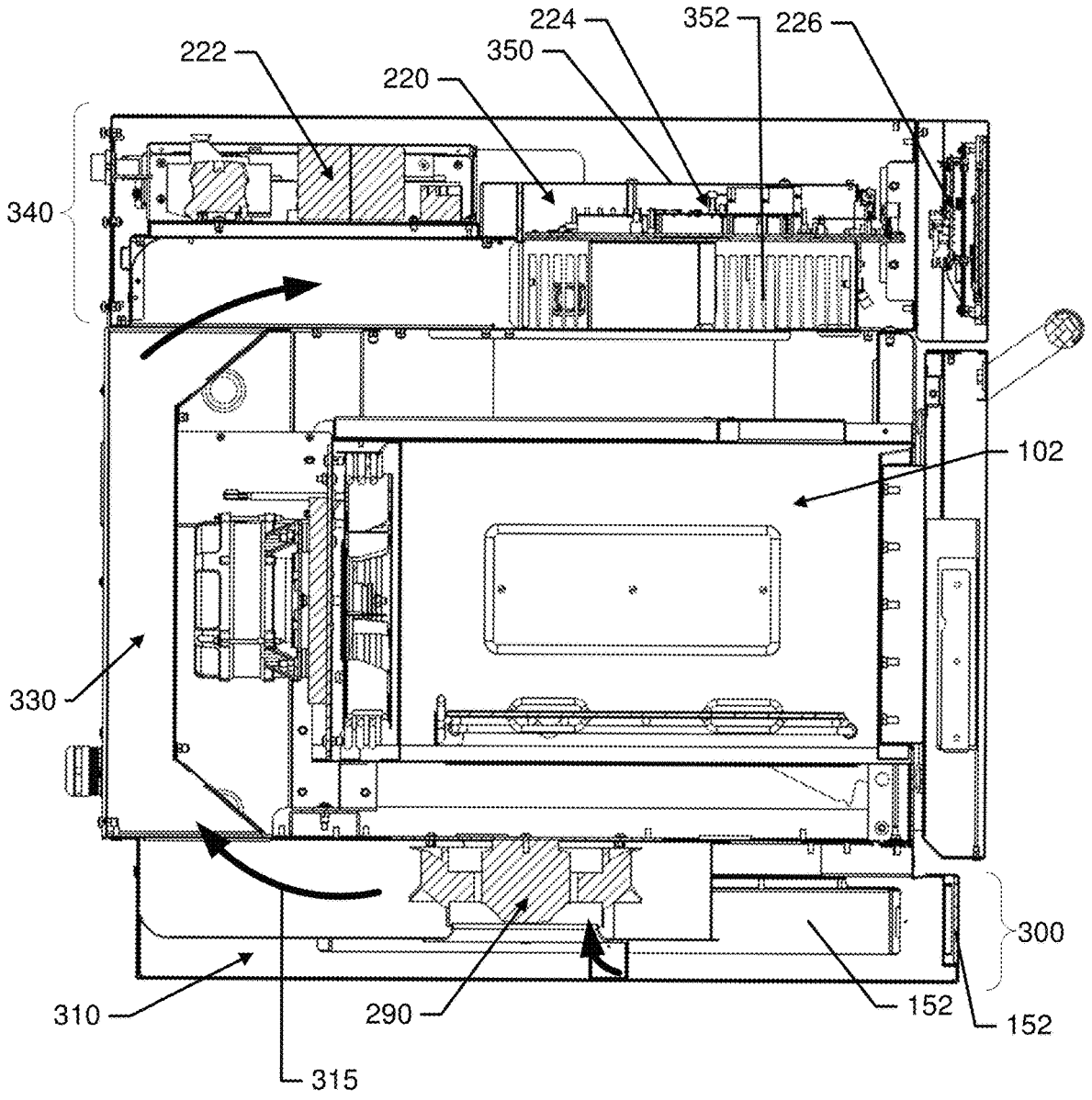
FIG. 3 shows a cross sectional view of the oven from a plane passing from the front to the back of the oven according to an example embodiment.

The typical airflow path, and various structures of the second air circulation system, can be seen in FIG. 3. In this regard, FIG. 3 shows a cross sectional view of the oven 100 from a plane passing from the front to the back of the oven 100. The basement (or basement region 300) of the oven 100 is defined below the cooking chamber 102, and includes an inlet cavity 310. During operation, air is drawn into the inlet cavity 310 through the inlet array 152 and is further drawn into the cooling fan 290 before being forced radially outward (as shown by arrow 315) away from the cooling fan 290 into a riser duct 330 (e.g., a chimney) that extends from the basement region 300 to the attic (or attic region 340) to turn air upward (as shown by arrow 315). Air is forced upward through the riser duct 330 into the attic region 340, which is where components of the control electronics 220 are disposed. The air then cools the components of the control electronics 220 before exiting the body 150 of the oven 100 via the outlet louvers 154. The components of the control electronics 220 may include power supply electronics 222, power amplifier electronics 224 and display electronics 226.

Upon arrival of air into the attic region 340, the air is initially guided from the riser duct 330 to a power amplifier casing 350. The power amplifier casing 350 may house the power amplifier electronics 224. In particular, the power amplifier electronics 224 may sit on an electronic board to which all such components are mounted. The power amplifier electronics 224 may therefore include one or more power amplifiers that are mounted to the electronic board for powering the antenna assembly 130. Thus, the power amplifier electronics 224 may generate a relatively large heat load. To facilitate dissipation of this relatively large heat load, the power amplifier electronics 224 may be mounted to one or more heat sinks 352. In other words, the electronic board may be mounted to the one or more heat sinks 352. The heat sinks 352 may include large metallic fins that extend away from the circuit board to which the power amplifier electronics 224 are mounted. Thus, the fins may extend downwardly (toward the cooking chamber 102). The fins may also extend in a transverse direction away from a centerline (from front to back) of the oven 100 to guide air provided into the power amplifier casing 350 and past the fins of the heat sinks 352.

Figure 4:
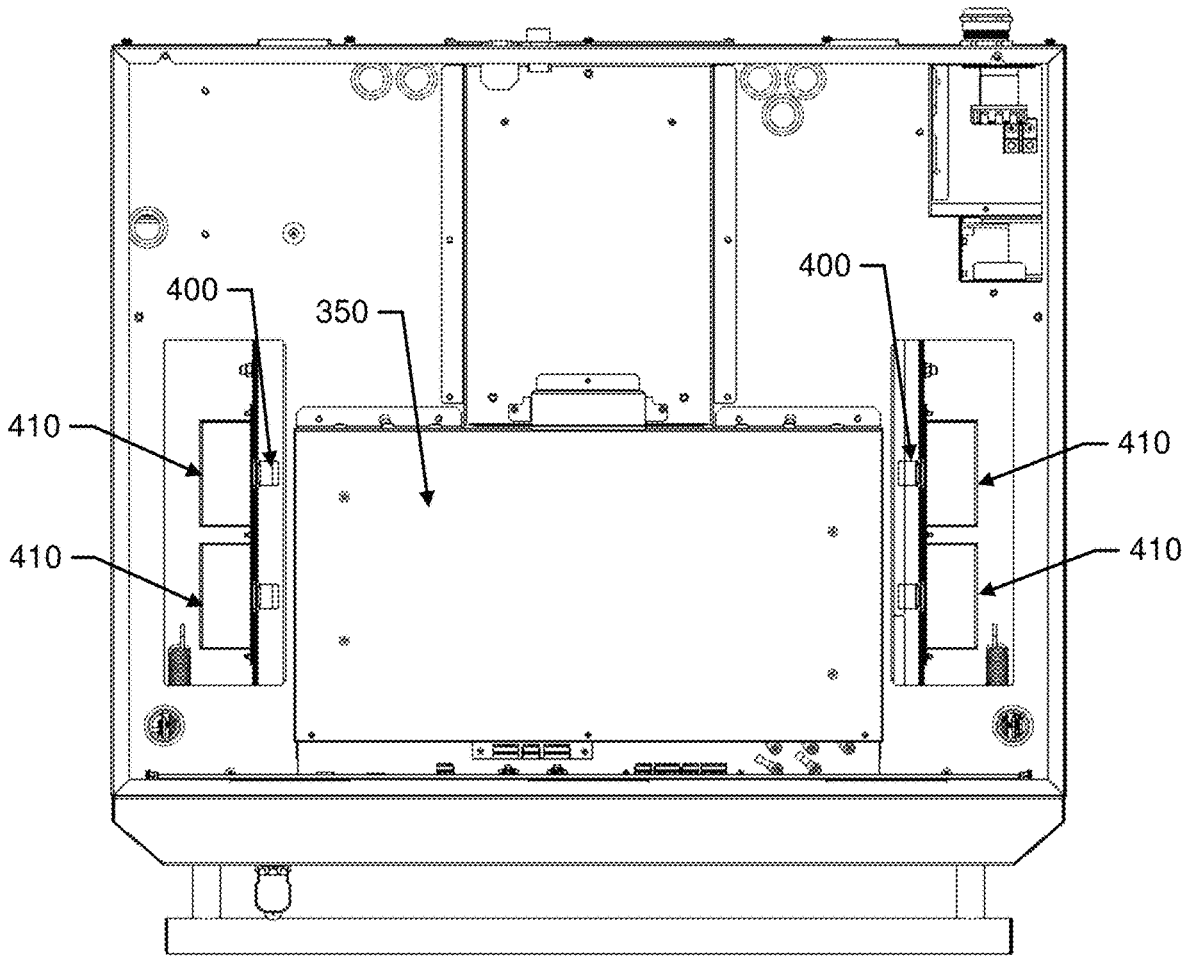
FIG. 4 is a top view of an attic region of the oven in accordance with an example embodiment.

FIG. 4 illustrates a top view of the attic region 340, and shows the power amplifier casing 350 and various components of the antenna assembly 130 including a launcher assembly 400 and waveguides of a waveguide assembly 410. Power is provided from the power amplifier electronics 224 to each launcher of the launcher assembly 400. The launcher assembly 400 operably couples a signal generated by the power amplifiers of the power amplifier electronics 224 into a corresponding one of the waveguides of the waveguide assembly 410 for communication of the corresponding signal into the cooking chamber 102 via the antenna assembly 130 as described above.

Figure 5:
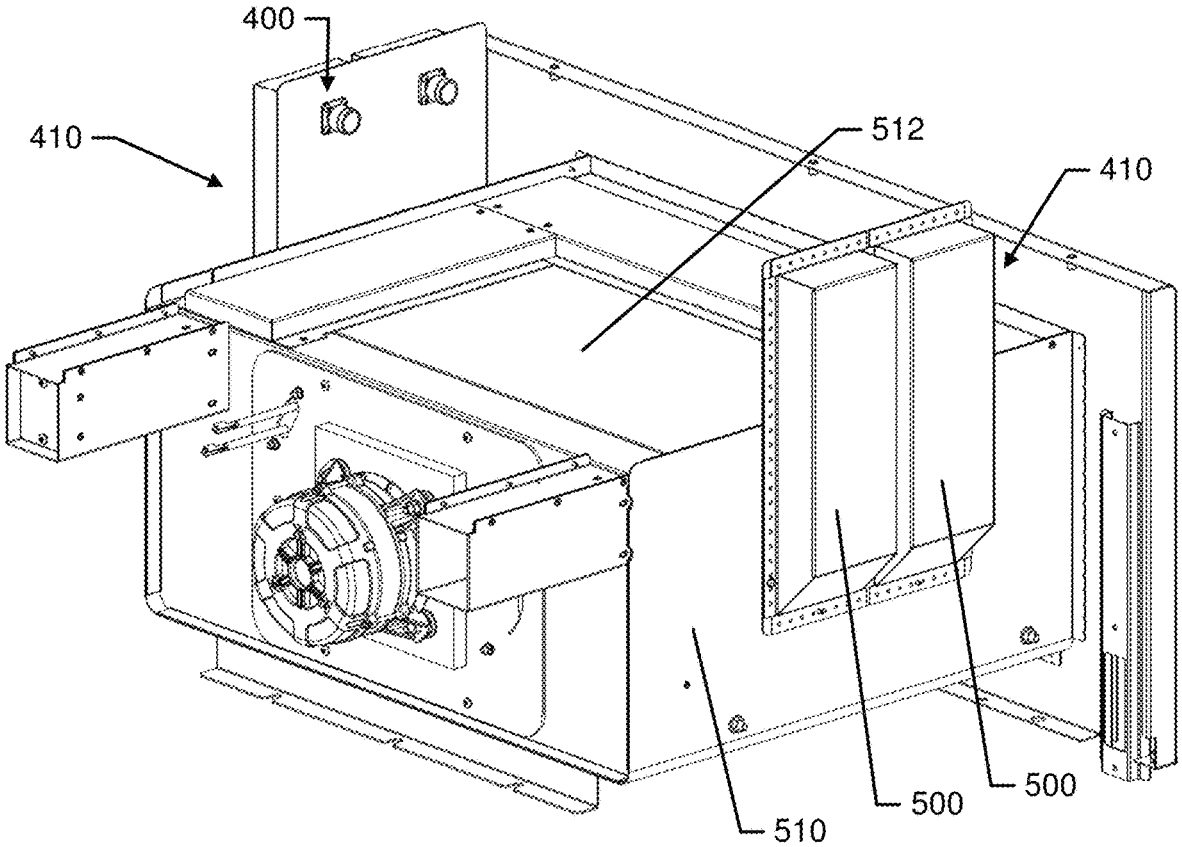
FIG. 5 illustrates a perspective view of various components of an antenna assembly to show their locations and orientations relative to the cooking chamber in accordance with an example embodiment.

FIG. 5 illustrates a perspective view of various components of the antenna assembly 130 to show their locations and orientations relative to the cooking chamber 102 in accordance with an example embodiment. As shown in FIG. 5, the launcher assembly 400 is disposed entirely higher in elevation than the cooking chamber 102. Meanwhile, the waveguide assembly 410 includes two waveguides 500 that extend downward (parallel to each other) from the launcher assemblies 400 to lie adjacent to each of the opposing sidewalls 510 that define the sides of the cooking chamber 102. The direction of longitudinal extension of each of the waveguides 500 is substantially parallel to the plane in which the sidewalls 510 lie and is substantially perpendicular to a plane in which a top wall 512 of the cooking chamber 102 lies. As such, in an example embodiment, only about one half (or slightly more than one half) of the longitudinal length of the waveguides 500 is proximate to the sidewalls 510 and a bottom end of the waveguides 500 terminates at a middle region of the cooking chamber 102. More particularly, the distal end of the waveguides 500 relative to the launcher assembly 400 terminates proximate a middle of the sidewall 510 (in both height and length dimensions of the sidewall 510).

As can be appreciated from consideration of FIGS. 3-5 together, the design of some example embodiments maximizes cooling efficiency of solid state components and cleanliness of the second air circulation system by providing the attic region 340 and control electronics 220 above the cooking chamber 102. The distance between the power amplifier electronics 224 and the launcher assembly 400 can therefore be minimized by having the waveguides 500 extend upward into the attic region 340 to place the launcher assembly 400 a close as possible to the power amplifier electronics 224. Running the waveguides 500 downward alongside the sidewalls 510 then minimizes space consumption and any needed bending of the waveguides 500. In fact, only one bend is needed to steer RF energy generated at the launcher assembly 400 from the waveguides 500 and into the cooking chamber 102. Thus, example embodiments provide a space efficient design for the waveguide assembly 410 that also complements other advantageous design features for other systems of the oven 100.

Figure 6:
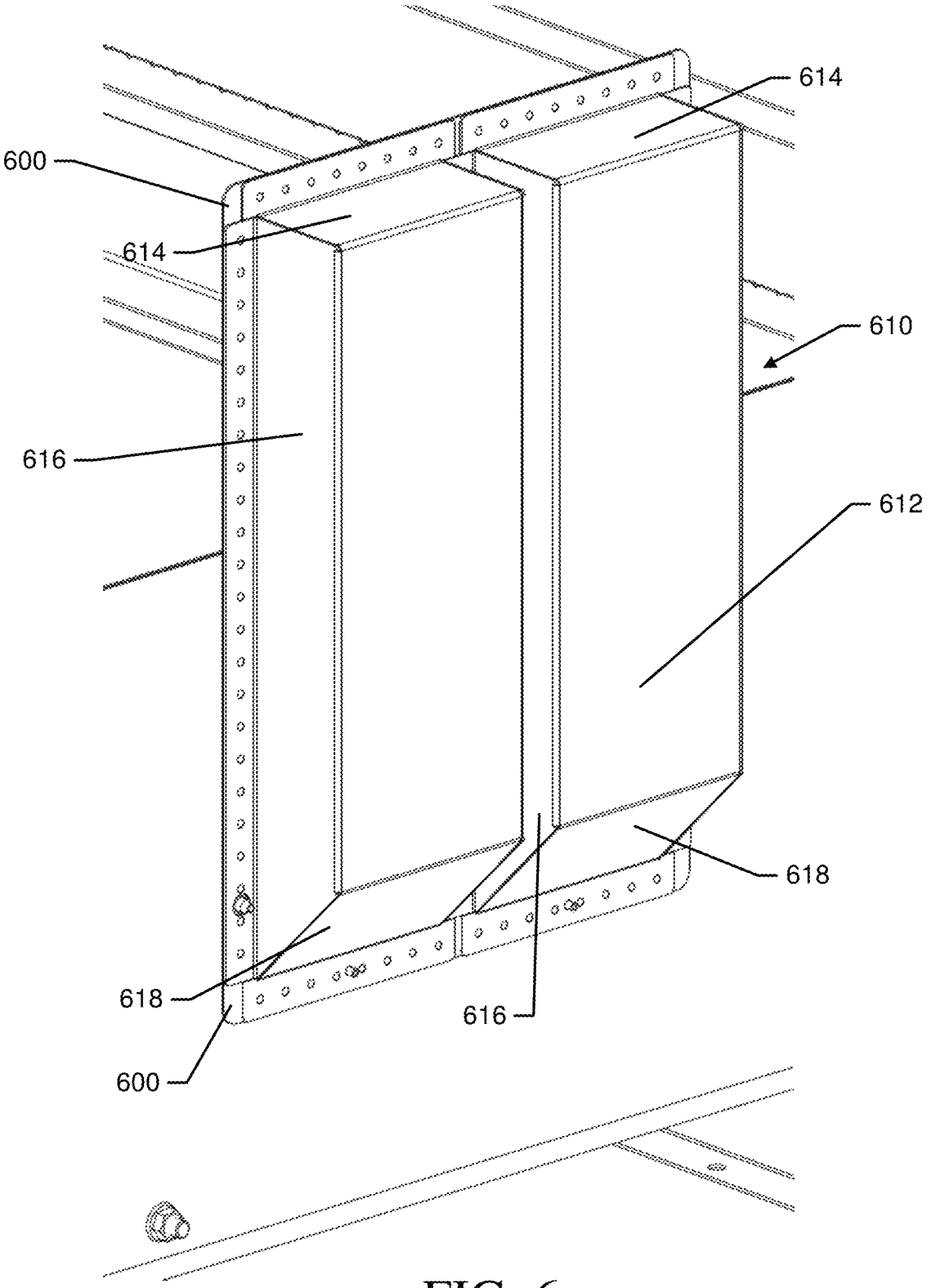
FIG. 6 illustrates a front perspective view of the waveguide assembly in accordance with an example embodiment.
Figure 7:
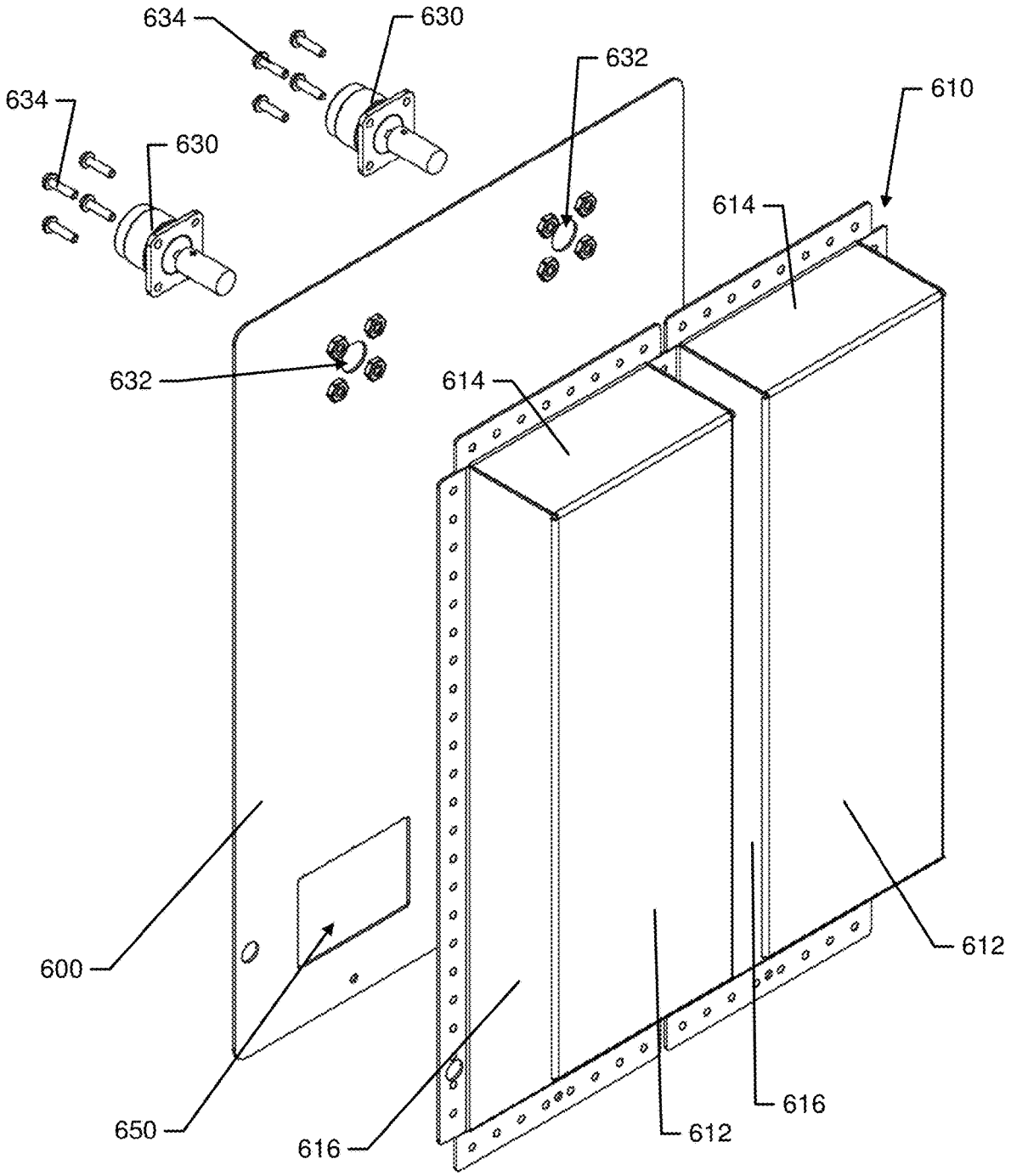
FIG. 7 illustrates an exploded perspective view of the waveguide assembly from the same perspective shown in FIG. 6 in accordance with an example embodiment.
Figure 8B:
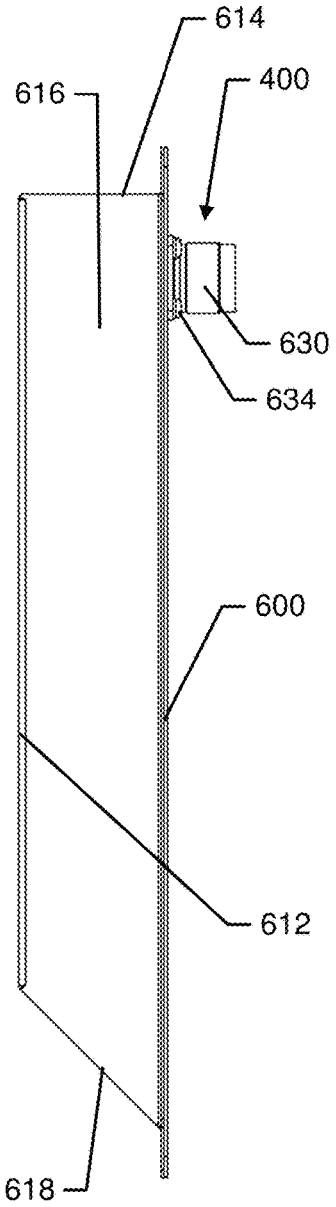
FIG. 8B is a side view of the waveguide assembly in accordance with an example embodiment.
Figure 8A:
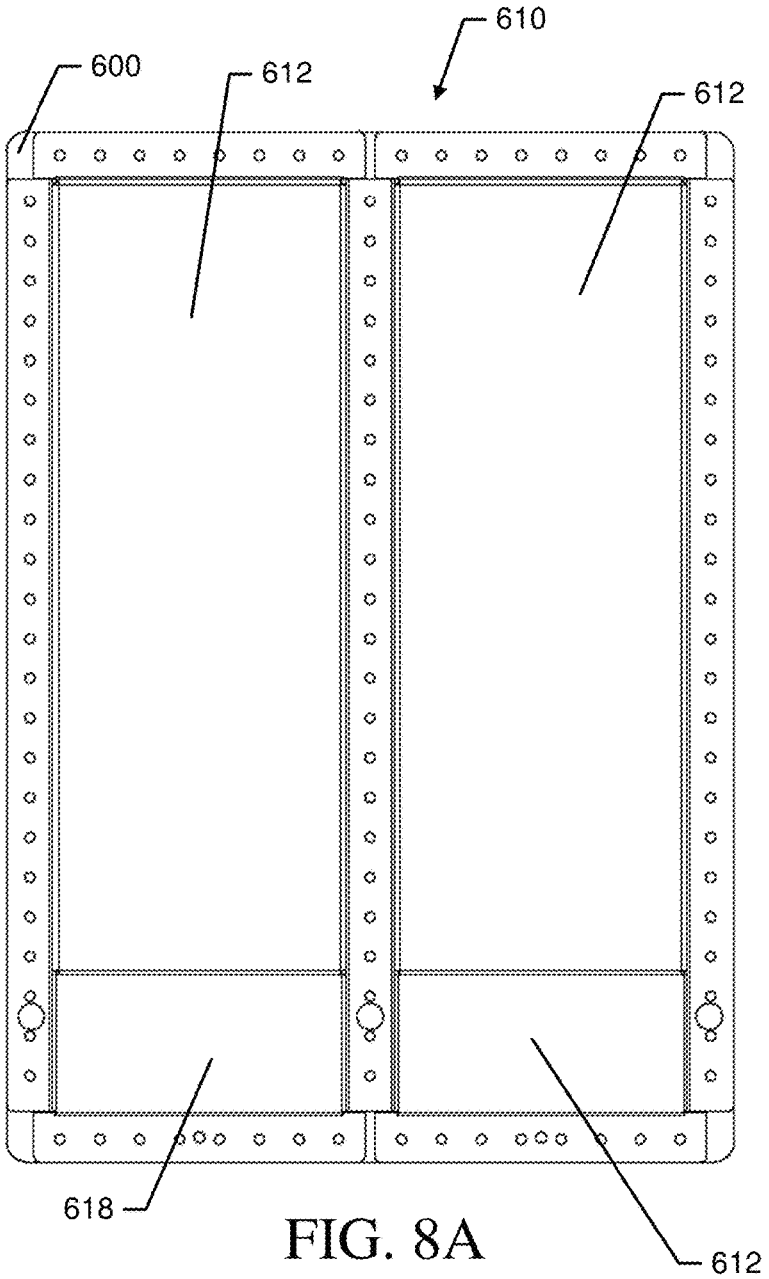
FIG. 8A illustrates a front view of the waveguide assembly in accordance with an example embodiment.
Figure 9A:
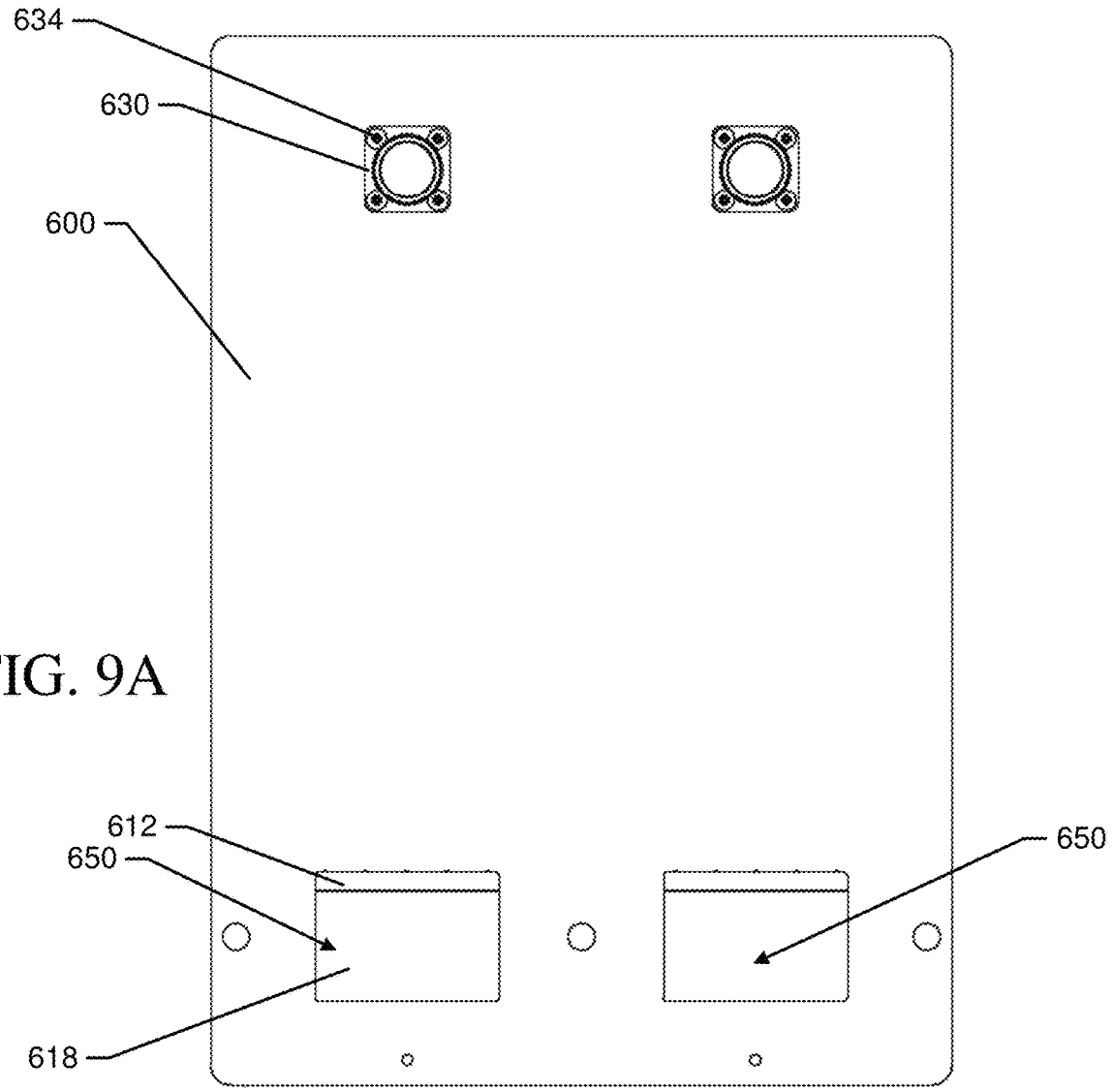
FIG. 9A illustrates back view of the waveguide assembly in accordance with an example embodiment.
Figure 9B:
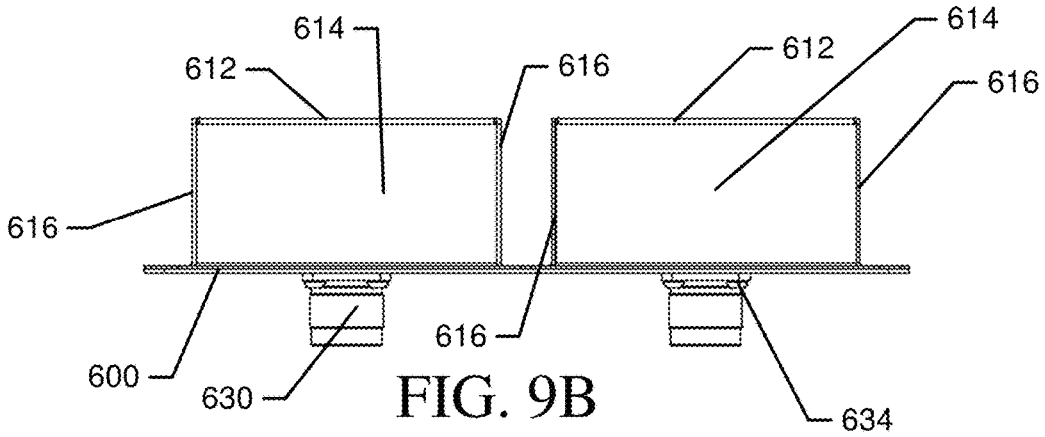
FIG. 9B is a top view of the waveguide assembly in accordance with an example embodiment.
Figure 10:
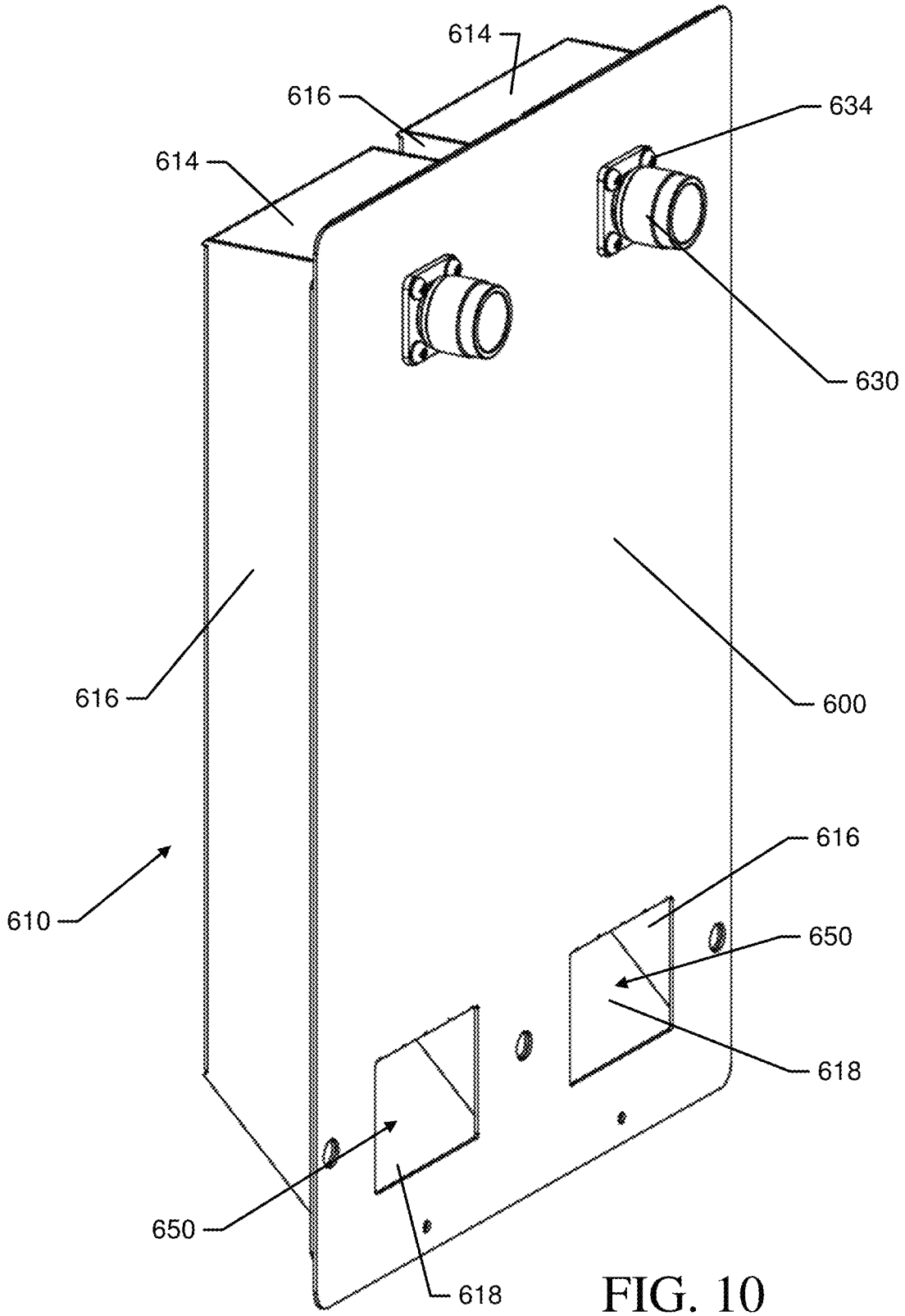
FIG. 10 is a back perspective view of the waveguide assembly in accordance with an example embodiment.
Figure 11:
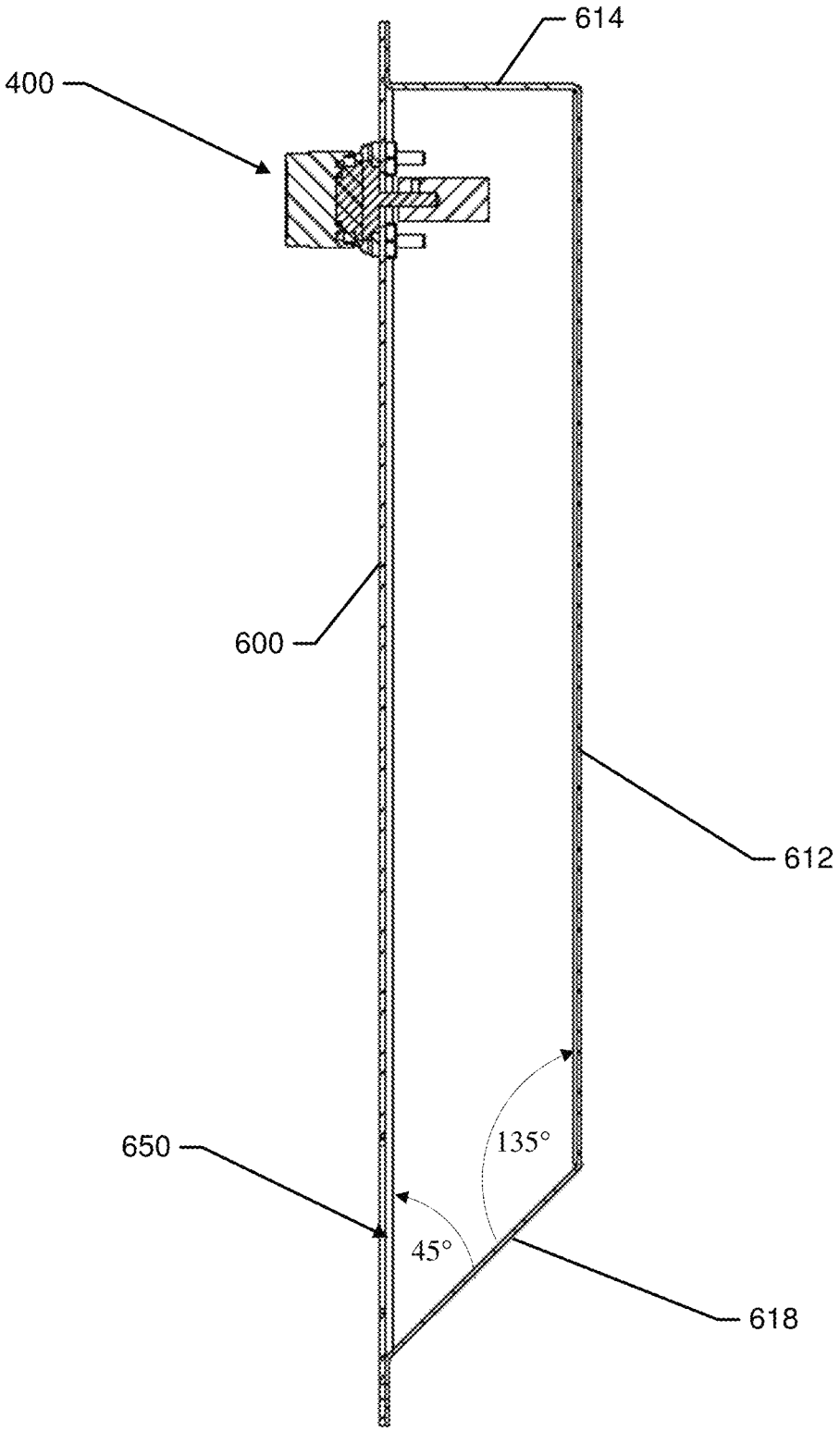
FIG. 11 is a cross section view of one of the waveguides in accordance with an example embodiment.

A more detailed look at the design of the launcher assembly 400 and the waveguide assembly 410 will now be discussed in reference to FIGS. 6-11. In this regard, FIG. 6 illustrates a front perspective view of the waveguide assembly 410. FIG. 7 illustrates an exploded perspective view of the waveguide assembly 410 from the same perspective shown in FIG. 6. FIG. 8A illustrates a front view of the waveguide assembly 410, and FIG. 8B is a side view of the waveguide assembly 410. FIG. 9A illustrates back view of the waveguide assembly 410, and FIG. 9B is a top view of the waveguide assembly 410. FIG. 10 is a back perspective view of the waveguide assembly 410, and FIG. 11 is a cross section view of one of the waveguides 500.

Referring now to FIGS. 6-11, the waveguide assembly 410 adjacent to each respective sidewall 510 of the cooking chamber 102 includes two adjacent waveguides 500. The waveguides 500 each start at about the same elevation at a proximal end thereof (relative to the launcher assembly 400), and terminate at about the same elevation at a distal end thereof. The waveguides 500 each define a rectangular hollow structure via formation of a hollow metallic conductor that may, in some cases, be lined with a dielectric coating. However, in some embodiments, no dielectric coating is needed. In some cases, the metal may be steel, however, some examples may line the interior of the waveguides 500 with copper, silver or gold.

The waveguides 500 may each be formed from at least two metallic portions. In this regard, a common back plate 600 may be shared by both of the waveguides 500 that form one of the waveguide assemblies 410 adjacent to a corresponding one of the sidewalls 510. The back plate 600 may be substantially rectangular sheet of metal or other conductive material (e.g., about 0.1 inches in thickness), and the back plate 600 may lie proximate to a portion of the corresponding one of the sidewalls 510. The back plate 600 may interface with a front plate 610 (e.g., about 0.1 inches in thickness) to form each of the waveguides 500. The front plate 610 may form two waveguides 500 that each include a front face 612 a top face 614, two side faces 616 that oppose each other, and a bottom face 618. The front face 612 may be substantially parallel to the back plate 600 and spaced apart from the back plate 600 by the width of the two side faces 616 and the top face 614. As such, the two side faces 616 may be substantially parallel to each other and substantially perpendicular to the front face 612. The top face 614 may also extend substantially perpendicular to the front face 612, and to each of the two side faces 616. The top face 614 and the two side faces 616 may extend between the front face 612 and the back plate 600 to define the hollow rectangular shape of a majority of the waveguide 500. However, the bottom face 618 may be angled relative to the front face 612 (e.g., at an angle of about 135 degrees) while extending between the front face 612 and the back plate 600.

In an example embodiment, the front face 612, top face 614, two side faces 616 and the bottom face 618 may each be formed from a single unitary piece of material. Portions of the piece of material may be cut to allow the top face 614 and two side faces 616 to be formed by bending at 90 degree angles relative to the front face 612. The bottom face 618 may be formed by bending the corresponding portion of the piece of material 45 degrees out of the plane in which the front face 612 lies toward the back plate 600. Joints between the folded portions may then be welded, and peripheral edges may also be bent to be parallel to the back plate 600 to be joined to the back plate 600 by rivets, welding or any other suitable joining method.

Each instance of the back plate 600 may have at least four orifices or openings formed therein that are designed to be penetrations into or out of the waveguide 500. Two such openings may be provided for the launcher assembly 400. As such, for example, a launcher 630 may penetrate through a launcher orifice 632 formed in the back plate 600. The launcher 630 may secure and hold an antenna element that is passed into the waveguide 500 to generate RF energy in the waveguide 500. The launcher 630 may be welded or snap fitted to the back plate 600, or in some cases, the launcher 630 may be affixed to the back plate 600 via fasteners 634. The fasteners 634 (if employed) may also pass through corresponding portions of the back plate 600. However, the orifices for receiving the fasteners 634 are closed off by the fasteners 634 themselves and therefore not penetrations into our out of the waveguide 500 when the waveguide assembly 410 is fully constructed and operational.

Two other penetrations out of the waveguides 500 that are formed in the back plate 600 are provided as radiation openings 650 via which RF energy passes from the waveguides 500 into the cooking chamber 102. The radiation openings 650 may be substantially rectangular in shape, and may be disposed at the back plate 600 to face bottom face 618. As such, a majority portion of the bottom face 618 may be visible through the radiation opening 650. However, at least a small portion of an interior of the front face 612 may also face (and be visible though) the radiation opening 650 in some cases. Moreover, the radiation opening 650 may not be formed at the intersection between the bottom face 618 and the back plate 600, but instead a portion of the back plate 600 may extend away from the intersection between the bottom face 618 and the back plate 600 by about 10% to 25% of the height of the radiation opening 650 to offset the radiation opening 650 away from the intersection.

Dimensions of the waveguide 500 and portions thereof may be dependent upon the frequencies employed by the RF generator 204. Thus, for example, if the RF generator 204 employed frequencies in the range of about 2.4 GHz to about 2.5 GHz, the width of the front face 612 may be about 3.5 inches and the length may be about 9.4 inches. The length and width of the top face 614 may be about 3.5 inches and about 1.8 inches, respectively. The width of the two side faces 616 may also be 1.8 inches, except where the width tapers proximate to the bottom face 618. The length of the two side faces 616 to the tapered part thereof (corresponding to the region adjacent to the bottom face 618) is about 9.4 inches, and the length of the tapered part of the two side faces 616 is about 1.7 inches.

Adjacent (i.e., inner) side faces 616 of different ones of the waveguides 500 may be spaced apart from each other by about 0.6 inches, while distally located (i.e., outer) side faces 616 may be about 7.5 inches apart. In some embodiments, the back plate 600 may extend about 0.6 inches farther outward from the points at which the front face 612, the top face 614, the two side faces 616 and the bottom face 618 intersect with the back plate 600 so that peripheral edges of the front plate 610 have at least a half inch overlap with the back plate 600 for joining purposes. The back plate 600 may be substantially rectangular in shape, and have a length of about 12.2 inches, and a width of about 8.6 inches.

Accordingly, the waveguide 500 is essentially defined as a 3.5 inch by 1.8 inch hollow rectangular structure over a majority of the length of the waveguide 500 for this example frequency. The center of the launcher 630 may be provided at a location centered about 1 inch from the top wall 314 (and therefore about 1.6 inches from the top edge of the back plate 600). The center of the launcher 630 may also be centered relative to the waveguide 500 (e.g., centered along the longitudinal centerline of the waveguide 500). Each of the radiation openings 650 may also be centered relative to the longitudinal centerline of the waveguide 500. However, the radiation openings 650 may be positioned to be centered about 10.5 inches away from the top edge of the back plate 600. In an example embodiment, the radiation openings 650 may each be about 2.1 inches wide and about 1.5 inches high. Longitudinal centerlines of the adjacent waveguides 500 may be about 4.1 inches apart, and each may be about 2.3 inches from respective side edges of the back plate 600.

The launcher assembly 400 may penetrate through the back plate 600 proximate to the proximal end of the waveguide 500 to insert RF energy into the waveguide 500 via an antenna held by the launcher 630. The RF energy may then propagate down the waveguide 500 and be reflected at the bottom face 618 toward (and into) the cooking chamber 102. Traditional microwave energy insertion into a cooking chamber is provided over a wider frequency band, and with little coherence. However, the frequency of the RF energy provided in connection with example embodiments may be targeted to specific frequencies. As such, placement of the bend formed by the bottom face 618 immediately adjacent to the radiation opening 650 may allow for the RF energy to enter into the cooking chamber 102 with less distortion and/or destructive interference than might otherwise occur with alternate locational placements of the radiation opening 650.

In an example embodiment, an oven may be provided. The oven may include a cooking chamber configured to receive a food product and an RF heating system configured to provide RF energy into the cooking chamber using solid state electronic components. The cooking chamber is defined at least in part by a top wall, a first sidewall and a second sidewall. The solid state electronic components include power amplifier electronics configured to provide the RF energy into the cooking chamber via a launcher assembly operably coupled to the cooking chamber via a waveguide assembly. The waveguide assembly includes a waveguide extending along at least one of the first sidewall or the second sidewall to provide the RF energy into the cooking chamber through a radiation opening provided at the at least one of the first sidewall or the second sidewall. The launcher assembly includes a launcher disposed proximate to a first end of the waveguide and the radiation opening is disposed proximate to a second end of the waveguide.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the waveguide may be defined by a back plate that lies adjacent to the at least one of the first sidewall or the second sidewall, and a front plate extending away from the back plate. The back plate may include the radiation opening. The front plate may be defined by a front face extending substantially parallel to the back plate, a top face extending between the front face and the back plate substantially perpendicular to both the front face and the back plate, two side faces opposing each other on opposite lateral sides of the front face extending between the front face and the back plate, and a bottom face. The bottom wall may be disposed at an angle relative to the front face to extend between the front face and the back plate. In an example embodiment, the angle may be about 135 degrees. In some cases, the bottom face faces or opposes (i.e., lies directly opposite to) the radiation opening. In an example embodiment, at least a portion of the front face that is proximate to the bottom face also faces the radiation opening. In some cases, the launcher may be disposed at an elevation higher than the top wall and the radiation opening may be disposed proximate to a middle of the at least one of the first sidewall or the second sidewall. In an example embodiment, the waveguide assembly may include a second waveguide adjacent the waveguide. The waveguide and the second waveguide may be symmetrical with respect to each other about a longitudinal centerline of the back plate. In some cases, the front plate may include a single unitary piece of material. In such an example, the top face, two side faces and bottom face may each be bent away from the front face toward the back plate to form the waveguide. In an example embodiment, the first end of the waveguide may not be adjacent to the at least one of the first sidewall or the second sidewall, and the second end of the waveguide may be adjacent to the at least one of the first sidewall or the second sidewall. In some cases, a longitudinal direction of extension of the waveguide between the first and the second end may be oriented substantially perpendicular relative to a plane in which the top wall lies.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a cooking chamber configured to receive a food product, the cooking chamber being defined at least in part by a top wall, a first sidewall and a second sidewall; and a radio frequency (RF) heating system configured to provide RF energy into the cooking chamber using solid state electronic components, the solid state electronic components including power amplifier electronics configured to provide the RF energy into the cooking chamber via a launcher assembly operably coupled to the cooking chamber via a waveguide assembly;

wherein the waveguide assembly includes a waveguide extending along at least one of the first sidewall or the second sidewall to provide the RF energy into the cooking chamber through a radiation opening provided at the at least one of the first sidewall or the second sidewall, wherein the launcher assembly includes a launcher disposed proximate to a first end of the waveguide and the radiation opening is disposed proximate to a second end of the waveguide, wherein the waveguide is defined by a back plate that lies adjacent to the at least one of the first sidewall or the second sidewall, and a front plate extending away from the back plate, wherein the front plate is defined by a front face extending substantially parallel to the back plate, a top face extending between the front face and the back plate substantially perpendicular to both the front face and the back plate, two side faces opposing each other on opposite lateral sides of the front face extending between the front face and the back plate, and a bottom face, wherein the bottom wall is disposed at an angle relative to the front face to extend between the front face and the back plate, and wherein the radiation opening is disposed in the back plate of the waveguide assembly such that a portion of the bottom wall and a portion of an interior of the front face are visible through the radiation opening, the radiation opening being offset away from an intersection of the bottom face and the back plate.

2. The oven of claim 1, wherein the angle is about 135 degrees.

3. The oven of claim 2, wherein the bottom face faces the radiation opening.

4. The oven of claim 1, wherein the launcher is disposed at an elevation higher than the top wall and the radiation opening is disposed proximate to a middle of the at least one of the first sidewall or the second sidewall.

5. The oven of claim 1, wherein the waveguide assembly includes a second waveguide adjacent the waveguide, the waveguide and the second waveguide being symmetrical with respect to each other about a longitudinal centerline of the back plate.

6. The oven of claim 1, wherein the front plate comprises a single unitary piece of material, and wherein the top face, two side faces and bottom face are each bent away from the front face toward the back plate to form the waveguide.

7. The oven of claim 1, wherein a longitudinal direction of extension of the waveguide between the first and the second end is oriented substantially perpendicular relative to a plane in which the top wall lies.

8. A waveguide assembly for delivering RF energy generated by solid state electronic components into an oven, the oven including a cooking chamber configured to receive a food product, the cooking chamber being defined at least in part by a top wall, a first sidewall and a second sidewall, the waveguide assembly comprising:

a waveguide extending along at least one of the first sidewall or the second sidewall, and a radiation opening provided at the at least one of the first sidewall or the second sidewall to provide the RF energy into the cooking chamber from the waveguide, wherein a launcher is disposed proximate to a first end of the waveguide and the radiation opening is disposed proximate to a second end of the waveguide, wherein the waveguide is defined by a back plate that lies adjacent to the at least one of the first sidewall or the second sidewall, and a front plate extending away from the back plate, wherein the front plate is defined by a front face extending substantially parallel to the back plate, a top face extending between the front face and the back plate substantially perpendicular to both the front face and the back plate, two side faces opposing each other on opposite lateral sides of the front face extending between the front face and the back plate, and a bottom face, wherein the bottom wall is disposed at an angle relative to the front face to extend between the front face and the back plate, and wherein the radiation opening is disposed in the back plate of the waveguide assembly such that a portion of the bottom wall and a portion of an interior of the front face are visible through the radiation opening, the radiation opening being offset away from an intersection of the bottom face and the back plate.

9. The waveguide assembly of claim 8, wherein the angle is about 135 degrees.

10. The waveguide assembly of claim 9, wherein the bottom face faces the radiation opening.

11. The waveguide assembly of claim 8, wherein the launcher is disposed at an elevation higher than the top wall and the radiation opening is disposed proximate to a middle of the at least one of the first sidewall or the second sidewall.

12. The waveguide assembly of claim 8, wherein the waveguide assembly includes a second waveguide adjacent the waveguide, the waveguide and the second waveguide being symmetrical with respect to each other about a longitudinal centerline of the back plate.

13. The waveguide assembly of claim 8, wherein the front plate comprises a single unitary piece of material, and wherein the top face, two side faces and bottom face are each bent away from the front face toward the back plate to form the waveguide.

14. The waveguide assembly of claim 8, wherein a longitudinal direction of extension of the waveguide between the first and the second end is oriented substantially perpendicular relative to a plane in which the top wall lies.

15. The oven of claim 1, wherein a portion of the back plate extends away from the intersection of the bottom face and the back plate by about 10% to 25% of a height of the radiation opening to offset the radiation opening away from the intersection.

16. The waveguide assembly of claim 8, wherein a portion of the back plate extends away from the intersection of the bottom face and the back plate by about 10% to 25% of a height of the radiation opening to offset the radiation opening away from the intersection.

* * * * *